US005846059A

United States Patent [19]

Mizuno et al.

[11] Patent Number: 5,846,059

[45] Date of Patent: Dec. 8, 1998

[54] SCOTCH YOKE MECHANISM FOR MULTISTAGE COMPRESSOR HAVING A SPRING-BIASED LINER PLATE

[75] Inventors: Yoshihito Mizuno, Ota; Yoshihito Tajima, Tatebayashi; Atsunori Sugihara, Tokyo; Akifumi Kobayashi, Osaka; Manabu Hattori, Tokai; Tokio Yoshida, Fukuoka, all of Japan

[73] Assignees: Sanyo Electric Co., Ltd., Moriguchi; Tokyo Gas Co., Ltd., Tokyo; Osaka Gas Co., Ltd., Osaka; Toho Gas Co., Ltd., Nagoya; Saibu Gas Co., Ltd., Fukuoka, all of Japan

[21] Appl. No.: 702,317

[22] Filed: Aug. 23, 1996

[30] Foreign Application Priority Data

Aug. 24, 1995 [JP] Japan ..... 7-237890

[51] Int. Cl.[6] ..... F04B 1/04

[52] U.S. Cl. ..... 417/273; 74/50; 417/521

[58] Field of Search ..... 417/521, 273; 74/50; 92/138

[56] References Cited

U.S. PATENT DOCUMENTS

| | | | |
|---|---|---|---|
| 2,827,227 | 3/1958 | Schmidlin et al. | 74/50 |
| 3,067,624 | 12/1962 | Norton et al. | 74/50 |
| 3,834,840 | 9/1974 | Hartley | 417/535 |
| 5,033,940 | 7/1991 | Baumann . | |
| 5,092,185 | 3/1992 | Zornes et al. | 74/50 |

FOREIGN PATENT DOCUMENTS

678881A5 11/1991 Austria .

OTHER PUBLICATIONS

*Soviet Inventions Illustrated, section P/Q, week 8513, May 8, 1985, Derwent Publications Ltd., London*, SU 1113 575A (Astrakhan Fish).

*Primary Examiner*—Timothy Thorpe
*Assistant Examiner*—Cheryl J. Tyler
*Attorney, Agent, or Firm*—Weingarten, Schurgin, Gagnebin & Hayes LLP

[57] ABSTRACT

A multistage compressor has a yoke with a cross slider and roller bearings pressed against the sides of the cross slider by spring forces to enable the cross slider to slide smoothly within the yoke. The spring forces are generated by springs disposed between the yoke and a liner plate that urges the roller bearings against the cross slider. By this construction, the yoke and cross slider are not damaged during operation of the compressor even if the dimensions of the members change due to thermal expansion.

3 Claims, 4 Drawing Sheets

SCOTCH YOKE MECHANISM FOR MULTISTAGE COMPRESSOR HAVING A SPRING-BIASED LINER PLATE

BACKGROUND OF THE INVENTION

The present invention relates to a multistage compressor for compressing predetermined gas with high pressure at multiple stages, more particularly to a multistage compressor comprising a yoke and a cross slider wherein the yoke and the cross slider are not damaged even if the temperature rises in use and the dimensions of the members are changed due to thermal expansion.

FIGS. 30 to 32 in Volume 10 of "Mechanical Engineering Handbook" published on Sep. 15 in 1970 by Japan Society of Mechanical Engineers (JSME) show the constitution of a compressing apparatus like that of the presently-disclosed compressor. This JSME publication shows that as the number of compressing stages is increased, the diameters of the cylinder and piston are reduced in the reciprocatively compressing sections to which higher pressures are applied. The JSME publication also shows that the reciprocatively compressing sections can be arranged in the shape of an "L", a "V", a "W", a half star, a star and a balanced opposed type. The JSME publication also shows a mechanism for performing a multistage compressing operation being interlocked with a crankshaft so that each compressing section is operated at a stroke shifted by a required phase. The mechanism is operated by a driving source such as a motor.

U.S. Pat. No. 5,033,940 shows a multistage compressor in which four reciprocatively compressing sections 101, 102, 103 and 104 are arranged so that they are reciprocated on perpendicular axes 105 and 106 as shown in FIG. 4. Higher pressure is applied to the reciprocatively compressing sections 101–104 successively, and the reciprocatively compressing section 104 is the last stage of high pressure compressing sections.

In the above-described multistage compressor, a pair of opposite pistons 51 and 53 are coupled onto a yoke 1A coupled to a crankshaft 4 via a crank pin 3. A cross slider 2A is provided in the yoke 1A so that the cross slider 2A can be moved across an axis 106. Another pair of opposite pistons 52 and 54 are coupled onto a yoke 1B also coupled to the crankshaft 4 via the crank pin 3. The yoke 1B is arranged in a state in which the yoke 1A is rotated by 90 degrees, and a cross slider (not shown) is provided in the yoke 1B so that the cross slider can be moved across an axis 105.

Therefore, when the crankshaft 4 is rotated by an electric motor (not shown) and so on and the crank pin 3 is rotated around the crankshaft 4, the cross slider 2A is moved by the displacement of the crank pin 3 in the direction of the axis 105 in the yoke 1A, and the yoke 1A is moved in the direction of the axis 106. Therefore, the pair of pistons 51 and 53 are reciprocated only in the direction of the axis 106.

In the meantime, the cross slider (not shown) is moved in the direction of the axis 106 in the yoke 1B and the yoke 1B is moved in the direction of the axis 105. Therefore, the pair of pistons 52 and 54 are reciprocated only in the direction of the axis 105.

As a cross slider 2 is required to be slid naturally in a yoke 1 so as to obtain smooth reciprocation of the pistons 51, 52, 53 and 54 by converting rotational movement of the crankshaft 4, a pair of rolling bearings 5 are arranged between the yoke 1 and the cross slider 2 as shown in, for example FIG. 5.

However, in the multistage compressor constituted as described above, as gas is compressed in an adiabatic state, the temperature of the compressor members rises up to 120° to 130° C. and the dimensions of the members are altered even if the members are cooled by a cooling fan and so on.

For example if a yoke is formed by aluminum or an aluminum alloy, and a cross slider which is readily worn is formed by a steel, a gap between the yoke and the cross slider is widened during use due to the differences between their respective coefficients of thermal expansion.

Therefore, if the rolling bearings 5 are designed so that they normally function around ordinary temperature, and the gap described above is widened too much when the temperature rises, the rolling bearings 5 can become displaced. In this case the cross slider and yoke can be remarkably damaged due to excessive frictional force being applied as the slider slides with respect to the yoke.

In the meantime, if the rolling bearings are designed so that they function normally when the temperature rises, the gap described above is too narrow when the compressor is started, because the temperature is not high enough. In this case extremely great force is applied to the rolling bearings, and the rolling bearings cannot function normally. The cross slider and yoke can again be remarkably damaged.

A multistage compressor constitution is required which can bear the change of temperature during operation without damage to the yoke and cross slider occurring.

SUMMARY OF THE INVENTION

The present invention is made to solve the above-described problems in the prior art. The object is to provide a multistage compressor having at least a pair of opposite pistons, a crankshaft, and a Scotch yoke mechanism for fixing the piston to the crankshaft, in which the Scotch yoke mechanism has a yoke and a cross slider, and reciprocation of the pistons is obtained by converting rotation of the crankshaft by the Scotch yoke mechanism. The compressor is characterized in that a pair of rolling bearings and liner plates are arranged between the yoke and the cross slider, and the rolling bearings are pressed toward the cross slider or toward the yoke by spring forces generated by spring mechanisms received via the liner plates.

According to the present invention, the problem that the yoke and the cross slider are damaged when the temperature rises in use so that the dimensions of the members are changed due to thermal expansion can be solved.

DETAILED DESCRIPTION OF THE PREFERRED EMBODIMENTS

Figure 4:
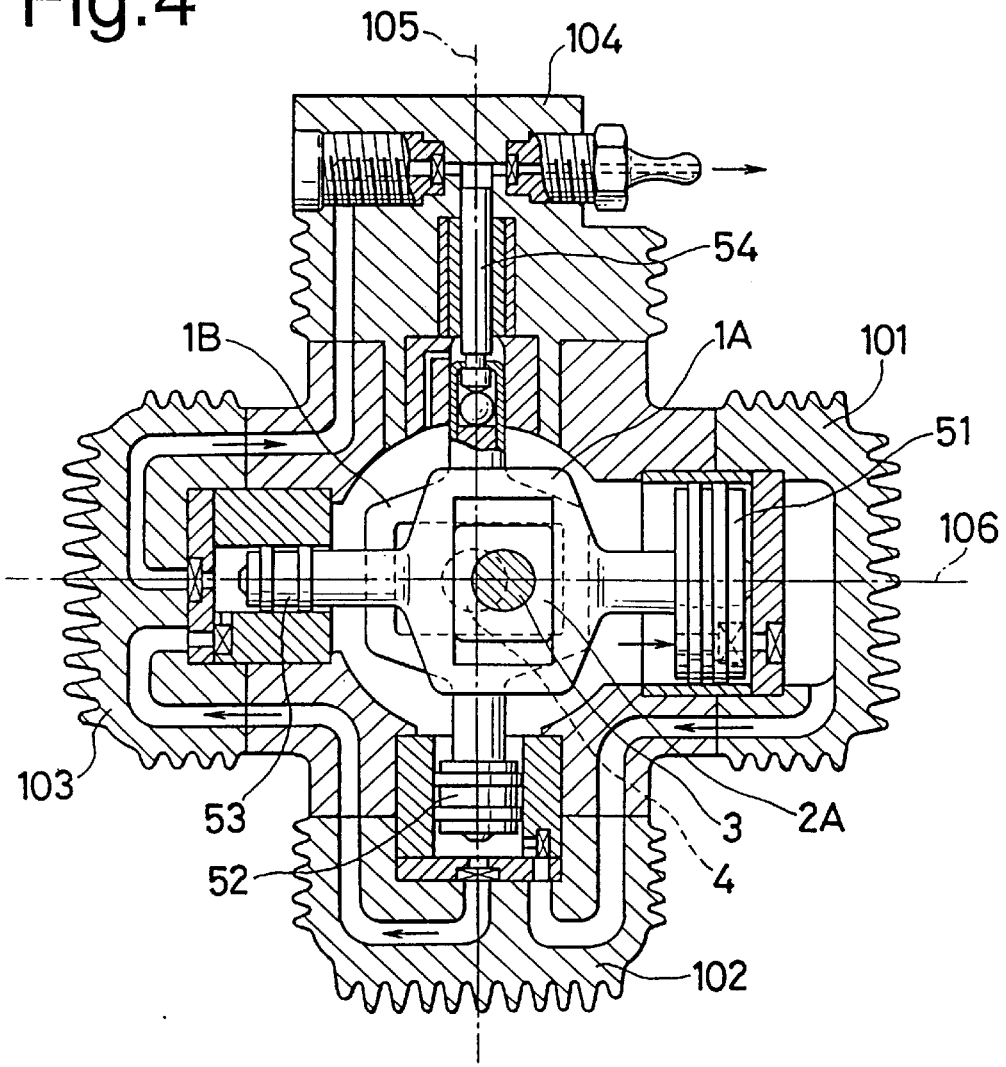
Fig.4 Prior Art
FIG. 4 is an explanatory view showing the prior art.
Figure 5:
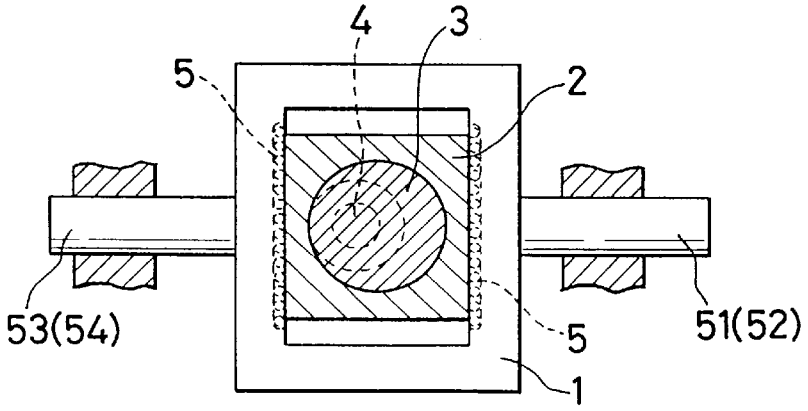
Fig.5 Prior Art
FIG. 5 is an explanatory view showing a Scotch yoke mechanism.
Figure 6:
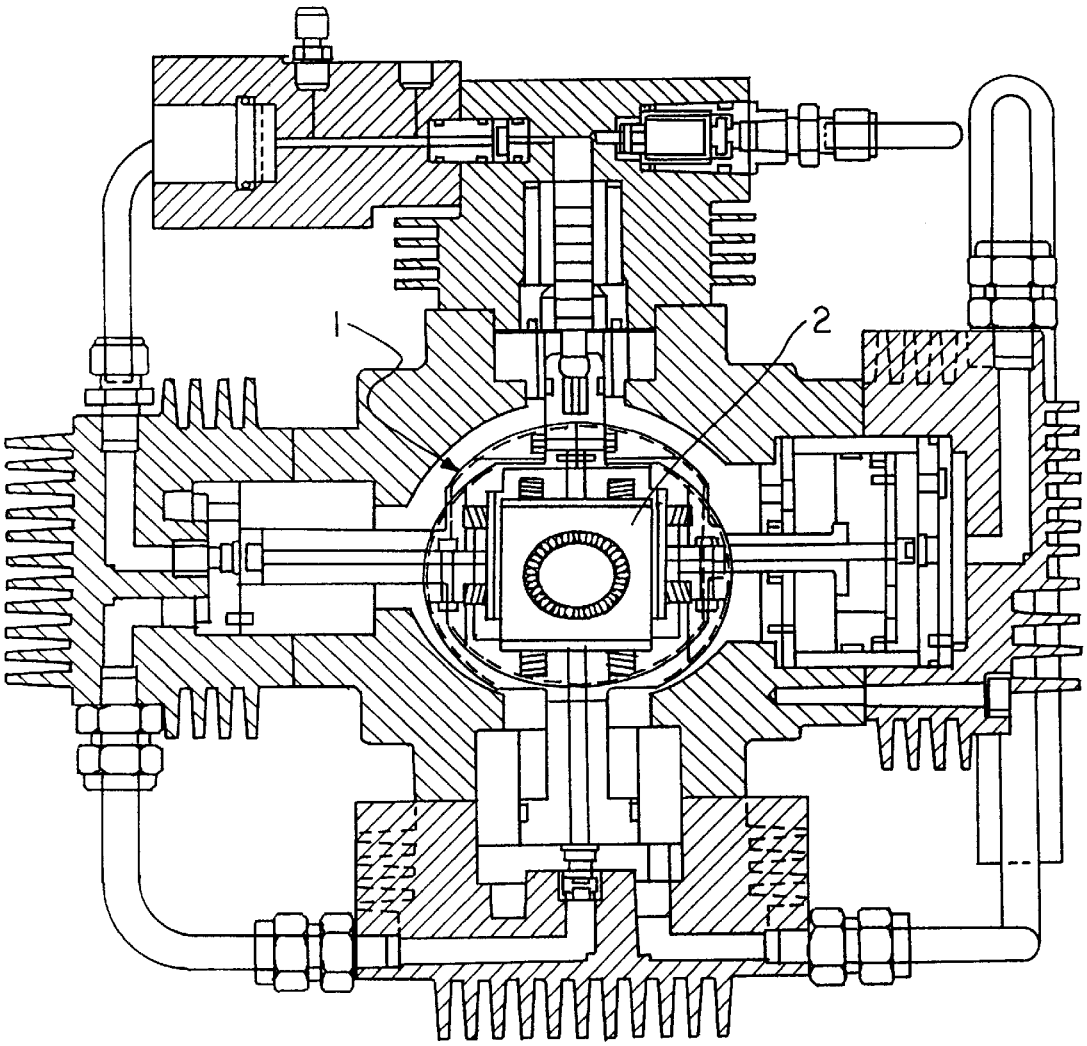
FIG. 6 is an explanatory view of a compressor incorporating the improved Scotch yoke mechanism according to an embodiment of the present invention.

Referring to FIGS. 1 to 3 and 6, embodiments according to the present invention will be described in detail below. Although in these drawings the parts shown with the same reference numbers as in FIGS. 4 and 5 described above has the same function as in the prior art, this should not prevent the present invention from being understood.

In a multistage compressor according to the present invention, a pair of rolling bearings 5 for assisting a cross slider 2 to slide in a yoke 1 are pressed on both sides of the cross slider 2 by spring forces generated by springs 7 received via each linear plate 6. The liner plates 6 are made of metal, for example steel.

The yoke 1 is provided with piston mounting holes 11 pierced so that grease can be injected therethrough in the center (grease is injected when a piston is not mounted). The yoke 1 is constituted with, for example two yoke members 1C in the shape of a oppositely-facing bowls so that the cross slider 2, the rolling bearings 5, the liner plates 6 and the springs 7 can be readily housed inside.

In this case, the yoke 1 is constituted so that two yoke members 1C can be connected together by, for example, passing bolts 8A through bolt holes 12 and fastening nuts 8B onto the screws of these bolts. The bolt holes 12 are provided by piercing the part in which the yoke members 1C are oppositely placed. However, if a positioning concave portion 13 is provided in a plurality of positions on each end face on which the yoke members are oppositely placed and a pin 9 is inserted into the concave portion, the yoke members 1C can be readily connected together.

Each concave portion 14 is deep enough to house the entire thickness of each of the liner plates 6 and the face of the rolling bearing 5 opposite to the liner plate 6, so that the face of the rolling bearing 5 opposite to the cross slider 2 protrudes from the concave portion 14. The concave portion 14 is formed inside each yoke member 1C in the shape of a bowl so that when the cross slider 2 is slid, the rolling bearing 5 and the liner plate 6 are not moved.

At least two concave portions 15 for positioning by inserting springs 7 are disposed in positions equally far from the center of each concave portion 14 in the direction in which the cross slider 2 is slid. When the cross slider 2 is slid, the force generated by the spring 7 operates uniformly on the rolling bearing 5.

Figure 1:
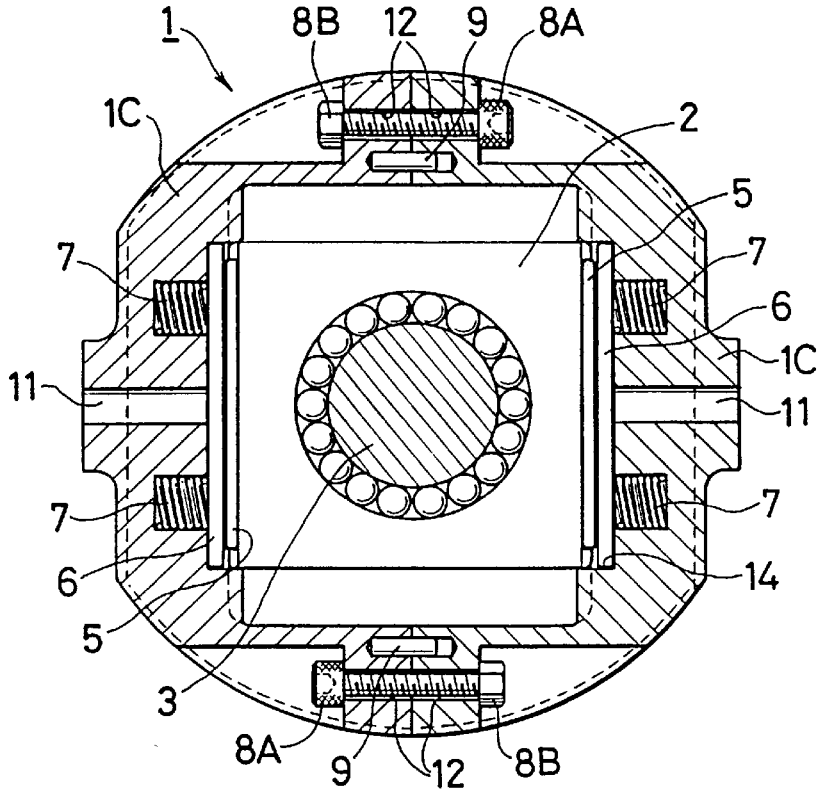
FIG. 1 is an explanatory view showing the main part according to an embodiment of the present invention.
Figure 2:
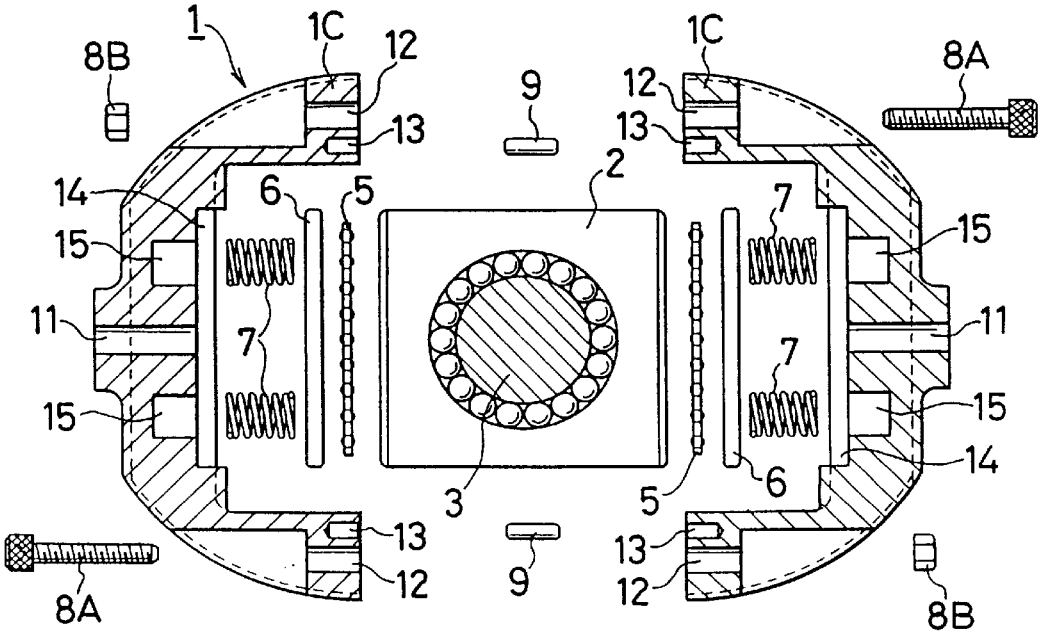
FIG. 2 is an exploded explanatory view of FIG. 1.
Figure 3:
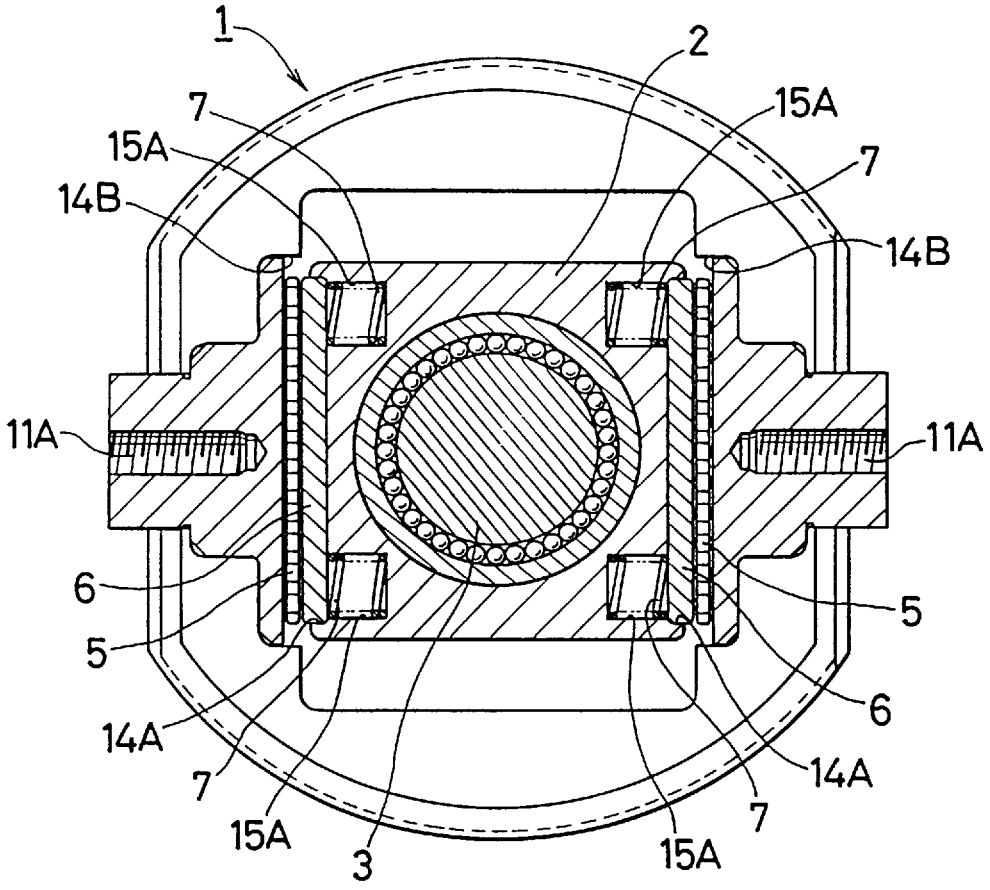
FIG. 3 is an explanatory view showing the main part according another embodiment of the present invention.

The multistage compressor according to the present invention may also be constituted as shown in FIG. 3, in which the rolling bearing 5 is pressed on the inner face of the yoke 1 by the force generated by the spring 7 received via the liner plate 6. In FIG. 3 an exploded view of the yoke 1 is not shown.

In this case, a concave portion 14A is formed on each side of the cross slider 2. The concave portion 14A is deep enough so the face of the liner plate 6 on the side opposite to the rolling bearing 5 protrudes. When the cross slider 2 is slid, the liner plate 6 is not moved. At least two concave portions 15A for positioning by inserting the springs 7 are disposed in positions equally far from the center of each concave portion 14A. When the cross slider 2 is slid, the forces generated by the spring 7 operates uniformly on the rolling bearing 5.

A concave portion 14B is also formed inside the yoke 1. The concave portion 14B is deep enough so that the face of the rolling bearing 5 on the side opposite to the cross slider 2 protrudes. Thus when the cross slider 2 is slid, the rolling bearing 5 is not moved readily. In this case, a piston mounting hole 11A is not pierced.

As described above, a multistage compressor according to the present invention is constituted so that the rolling bearing 5 is respectively pressed on both sides of the cross slider 2 or on the inner face of the yoke 1 by spring forces generated by the spring 7 received via the liner plate 6. The forces by which the rolling bearing 5 is pressed on the cross slider 2 or the yoke 1 are unchangeable even if the yoke 1 is formed by aluminum, an aluminum alloy or other such materials to reduce its weight and the cross slider 2 is formed by steel so that the dimensions of the members are changed due to temperature changes in use. Therefore, the function of the rolling bearing 5 can be secured and the degree to which the yoke 1 and the cross slider 2 are worn is greatly reduced.

The present invention is not limited to the above-described embodiments and a variety of transformations may be taken in the range in which they do not deviate from the object described in the claims.

For example, for the spring 7 a plate spring may be used in place of a helical spring and four concave portions 15 may be provided to each concave portion 14 or 14A so that the rolling bearing 5 can be pressed by four springs more uniformly.

As described above, a multistage compressor according to the present invention is constructed so that a pair of rolling bearings and liner plates are arranged between a yoke and a cross slider, and the rolling bearings are pressed toward the cross slider or toward the yoke by spring forces generated by spring mechanisms received via liner plates. Due to this construction, the force with which the rolling bearing is pressed on the cross slider or yoke is unchangeable even if the yoke is formed by, for example aluminum, an aluminum alloy or a similar weight-reducing material and the cross slider is formed by steel, so that the dimensions of the members are changed due to temperature changes in use. Therefore, the function of a rolling bearing can be secured and the degree to which the yoke and the cross slider are worn can be greatly reduced.

What is claimed is:

1. A multistage compressor comprising at least a pair of opposite compressing sections, pistons respectively disposed in the compressing sections, a crankshaft, and a Scotch yoke mechanism for fixing the pistons to the crankshaft, said Scotch yoke mechanism comprising a yoke and a cross slider, wherein reciprocation of the pistons is obtained by converting rotation of the crankshaft by the Scotch yoke mechanism, characterized in that a pair of rolling bearings and liner plates are arranged between said yoke and said cross slider and said rolling bearings are pressed by spring forces generated by spring mechanisms received via said liner plates.

2. A multistage compressor according to claim 1, wherein said rolling bearings are pressed toward the cross slider by the spring forces generated by spring mechanisms received via said liner plates.

3. A multistage compressor according to claim 1, wherein said rolling bearings are pressed toward the yoke by the spring forces generated by spring mechanisms received via said liner plates.

* * * * *